US009659574B2

(12) United States Patent
Kechichian et al.

(10) Patent No.: US 9,659,574 B2
(45) Date of Patent: May 23, 2017

(54) SIGNAL NOISE ATTENUATION

(71) Applicant: KONINKLIJKE PHILIPS N.V., Eindhoven (NL)

(72) Inventors: Patrick Kechichian, Eindhoven (NL); Sriram Srinivasan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/347,685

(22) PCT Filed: Oct. 16, 2012

(86) PCT No.: PCT/IB2012/055628

§ 371 (c)(1),
(2) Date: Mar. 27, 2014

(87) PCT Pub. No.: WO2013/057659

PCT Pub. Date: Apr. 25, 2013

(65) Prior Publication Data

US 2014/0249810 A1 Sep. 4, 2014

Related U.S. Application Data

(60) Provisional application No. 61/548,998, filed on Oct. 19, 2011.

(51) Int. Cl.

| | |
|---|---|
| ***G10L 21/00*** | (2013.01) |
| ***G10L 21/0208*** | (2013.01) |
| ***G10L 21/0216*** | (2013.01) |

(52) U.S. Cl.

CPC ..... *G10L 21/0208* (2013.01); *G10L 21/0216* (2013.01); *G10L 2021/02085* (2013.01)

(58) Field of Classification Search

CPC ..... G10L 2021/02085; G10L 21/0208; G10L 21/0216

(Continued)

(56) References Cited

U.S. PATENT DOCUMENTS 7,478,043 B1 * 1/2009 Preuss ..... G10L 15/20 704/231
2004/0167777 A1 * 8/2004 Hetherington ..... G10L 21/0208 704/226

(Continued)

FOREIGN PATENT DOCUMENTS

EP 2458586 A1 5/2012
WO 2012069973 A1 5/2012

OTHER PUBLICATIONS

Srinivasan et al: "Codebook Driven Short-Term Predictor Parameter Estimation for Speech Enhancement"; IEEE Transaction on Audio, Speech and Language Processing, vol. 14, No. 1, Jan. 2006, pp. 163-176.

(Continued)

*Primary Examiner* — Tammy Paige Goddard
*Assistant Examiner* — Bharatkumar Shah

(57) ABSTRACT

A noise attenuation apparatus receives a first signal comprising a desired and a noise signal component. Two codebooks (109, 111) comprise respectively desired signal candidates and noise signal candidates representing possible desired and noise signal components respectively. A noise attenuator (105) generates estimated signal candidates by for each pair of desired and noise signal candidates generating an estimated signal candidate as a combination of the desired signal candidate and the noise signal candidate. A signal candidate is then determined from the estimated signal candidates and the first signal is noise compensated based on this signal candidate. A sensor signal representing a measurement of the desired source or the noise in the environment is used to reduce the number of candidates searched thereby substantially reducing complexity and computational resource usage. The noise attenuation may specifically be audio noise attenuation.

15 Claims, 4 Drawing Sheets

(58) Field of Classification Search
USPC ..... 704/228
See application file for complete search history.

(56) References Cited

U.S. PATENT DOCUMENTS

2008/0140396 A1* 6/2008 Grosse-Schulte ..... G10L 15/20 704/227
2009/0141907 A1* 6/2009 Kim ..... G10L 21/0208 381/71.7

OTHER PUBLICATIONS

Kechichian et al: Model-Based Speech Enhancement Using a Bone-Conducted Signal; Journal of the Acoustic Society of America, vol. 131, No. 3, Mar. 2012, pp. EL262-EL267.
Srinivasan et al : "Codebook Based Bayesian Speech Enhancement for Non-Stationary Environments"; IEEE Transactions on Spech Audio Processing, vol. 15, No. 2, Feb. 2007, pp. 441-452.
Martin, "Spectrl Subtraction Based on Minimum Statistics", Signal Processing VII, Proc. Eusipco, 1994, p. 1182-1185.
Linde et al, "An Algorighm for Vector Quantizer Design", IEEE Transactions on Communications, vol. Com-28, No. 1, 1980, p. 84-95.
Shimamura et al, "A Reconstruction Filter for Bone-Conducted Speech", Circuits and Sysatems, 48th Midwest Symposium, vol. 2, 2005, p. 1847-1850.
"IEEE Recommended Practice for Speech Quality Measurement", IEEE Transactions on Audio and Electroacoustics, vol. 17, No. 3, 1969, p. 225-246.

* cited by examiner

SIGNAL NOISE ATTENUATION

FIELD OF THE INVENTION

The invention relates to signal noise attenuation and in particular, but not exclusively, to noise attenuation for audio and in particular speech signals.

BACKGROUND OF THE INVENTION

Attenuation of noise in signals is desirable in many applications to further enhance or emphasize a desired signal component. In particular, attenuation of audio noise is desirable in many scenarios. For example, enhancement of speech in the presence of background noise has attracted much interest due to its practical relevance.

An approach to audio noise attenuation is to use an array of two or more microphones together with a suitable beam forming algorithm. However, such algorithms are not always practical or provide suboptimal performance. For example, they tend to be resource demanding and require complex algorithms for tracking a desired sound source. Also they tend to provide suboptimal noise attenuation in particular in reverberant and diffuse non-stationary noise fields or where there are a number of interfering sources present. Spatial filtering techniques such as beam-forming can only achieve limited success in such scenarios and additional noise suppression is often performed on the output of the beam-former in a post-processing step.

Various noise attenuation algorithms have been proposed including systems which are based on knowledge or assumptions about the characteristics of the desired signal component and the noise signal component. In particular, knowledge-based speech enhancement methods such as codebook-driven schemes have been shown to perform well under non-stationary noise conditions, even when operating on a single microphone signal. Examples of such methods are presented in: S. Srinivasan, J. Samuelsson, and W. B. Kleijn, "Codebook driven short-term predictor parameter estimation for speech enhancement", IEEE Trans. Speech, Audio and Language Processing, vol. 14, no. 1, pp. 163{176, January 2006 and S. Srinivasan, J. Samuelsson, and W. B. Kleijn, "Codebook based Bayesian speech enhancement for non-stationary environments," IEEE Trans. Speech Audio Processing, vol. 15, no. 2, pp. 441-452, February 2007.

These methods rely on trained codebooks of speech and noise spectral shapes which are parameterized by e.g., linear predictive (LP) coefficients. The use of a speech codebook is intuitive and lends itself readily to a practical implementation. The speech codebook can either be speaker independent (trained using data from several speakers) or speaker dependent. The latter case is useful for e.g. mobile phone applications as these tend to be personal and often predominantly used by a single speaker. The use of noise codebooks in a practical implementation however is challenging due to the variety of noise types that may be encountered in practice. As a result a very large noise codebook is typically used.

Typically, such codebook based algorithms seek to find the speech codebook entry and noise codebook entry that when combined most closely matches the captured signal. When the appropriate codebook entries have been found, the algorithms compensate the received signal based on the codebook entries. However, in order to identify the appropriate codebook entries a search is performed over all possible combinations of the speech codebook entries and the noise codebook entries. This results in computationally very resource demanding process that is often not practical for especially low complexity devices. Furthermore, the large number of possible signal and in particular noise candidates may increase the risk of an erroneous estimate resulting in suboptimal noise attenuation.

Hence, an improved noise attenuation approach would be advantageous and in particular an approach allowing increased flexibility, reduced computational requirements, facilitated implementation and/or operation, reduced cost and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided noise attenuation apparatus comprising: a receiver for receiving an first signal for an environment, the first signal comprising a desired signal component corresponding to a signal from a desired source in the environment and a noise signal component corresponding to noise in the environment; a first codebook comprising a plurality of desired signal candidates for the desired signal component, each desired signal candidate representing a possible desired signal component; a second codebook comprising a plurality of noise signal candidates for the noise signal component, each desired signal candidate representing a possible noise signal component; an input for receiving a sensor signal providing a measurement of the environment, the sensor signal representing a measurement of the desired source or of the noise in the environment; a segmenter for segmenting the first signal into time segments; a noise attenuator comprising arranged to, for each time segment, performing the steps of: generating a plurality of estimated signal candidates by for each pair of a desired signal candidate of a first group of codebook entries of the first codebook and a noise signal candidate of a second group of codebook entries of the second codebook generating a combined signal; generating a signal candidate for the first signal in the time segment from the estimated signal candidates, and attenuating noise of the first signal in the time segment in response to the signal candidate; wherein the noise attenuator is arranged to generate at least one of the first group and the second group by selecting a subset of codebook entries in response to the reference signal.

The invention may provide improved and/or facilitated noise attenuation. In many embodiments, a substantially reduced computational resource is required. The approach may allow more efficient noise attenuation in many embodiments which may result in faster noise attenuation. In many scenarios the approach may enable or allow real time noise attenuation. In many scenarios and applications more accurate noise attenuation may be performed due to a more accurate estimation of an appropriate codebook entry due to the reduction in possible candidates considered.

Each of the desired signal candidates may have a duration corresponding to the time segment duration. Each of the noise signal candidates may have a duration corresponding to the time segment duration.

The sensor signal may be segmented into time segments which may overlap or specifically directly correspond to the time segments of the audio signal. In some embodiments, the segmenter may segment the sensor signal into the same time segments as the audio signal. The subset for each time segment may be determined based on the sensor signal in the same time segment.

Each of the desired signal and noise candidates may be represented by a set of parameters which characterizes a signal component. For example, each desired signal candidate may comprise a set of linear prediction coefficients for a linear prediction model. Each desired signal candidate may comprise a set of parameters characterizing a spectral distribution, such as e.g. a Power Spectral Density (PSD).

The noise signal component may correspond to any signal component not being part of the desired signal component. For example, the noise signal component may include white noise, colored noise, deterministic noise from unwanted noise sources, etc. The noise signal component may be non-stationary noise which may change for different time segments. The processing of each time segment by the noise attenuator may be independent for each time segment. Thus, the noise in the audio environment may originate from discrete sound sources or may e.g. be reverberant or diffuse sound components.

The sensor signal may be received from a sensor which performs the measurement of the desired source and/or the noise.

The subset may be of the first and second codebook respectively. Specifically, when the sensor signal provides a measurement of the desired signal source the subset can be a subset of the first codebook. When the sensor signal provides a measurement of the noise the subset can be a subset of the second codebook.

The noise estimator may be arranged to generate the estimated signal candidate for a desired signal candidate and a noise candidate as a weighted combination, and specifically a weighted summation, of the desired signal candidate and a noise candidate where the weights are determined to minimize a cost function indicative of a difference between the estimated signal candidate and the audio signal in the time segment.

The desired signal candidates and/or noise signal candidates may specifically be parameterized representations of possible signal components. The number of parameters used to define a candidate may typically be no more than 20, or in many embodiments advantageously no more than 10.

At least one of the desired signal candidates of the first codebook and the noise signal candidates of the second codebook may be represented by a spectral distribution. Specifically, the candidates may be represented by codebook entries of parameterized Power Spectral Densities (PSDs), or equivalently by codebook entries of linear prediction parameters.

The sensor signal may in some embodiments have a smaller frequency bandwidth than the first signal. In some embodiments, the noise attenuation apparatus may receive a plurality of sensor signals and the generation of the subset may be based on this plurality of sensor signals.

The noise attenuator may specifically include a processor, circuit, functional unit or means for generating a plurality of estimated signal candidates by for each pair of a desired signal candidate of a first group of codebook entries of the first codebook and a noise signal candidate of a second group of codebook entries of the second codebook generating a combined signal; a processor, circuit, functional unit or means for generating a signal candidate for the first signal in the time segment from the estimated signal candidates; a processor, circuit, functional unit or means for attenuating noise of the first signal in the time segment in response to the signal candidate; and a processor, circuit, functional unit or means for generating at least one of the first group and the second group by selecting a subset of codebook entries in response to the reference signal.

The signal may specifically be an audio signal, the environment may be an audio environment, the desired source may be an audio source and the noise may be audio noise.

Specifically, the noise attenuation apparatus may comprise: a receiver for receiving an audio signal for an audio environment, the audio signal comprising a desired signal component corresponding to audio from a desired audio source in the audio environment and a noise signal component corresponding to noise in the audio environment; a first codebook comprising a plurality of desired signal candidates for the desired signal component, each desired signal candidate representing a possible desired signal component; a second codebook comprising a plurality of noise signal candidates for the noise signal component, each desired signal candidate representing a possible noise signal component; an input for receiving a sensor signal providing a measurement of the audio environment, the sensor signal representing a measurement of the desired audio source or of the noise in the audio environment; a segmenter for segmenting the audio signal into time segments; a noise attenuator arranged to, for each time segment, performing the steps of: generating a plurality of estimated signal candidates by for each pair of a desired signal candidate of a first group of codebook entries of the first codebook and a noise signal candidate of a second group of codebook entries of the second codebook generating a combined signal; generating a signal candidate for the audio signal in the time segment from the estimated signal candidates, and attenuating noise of the audio signal in the time segment in response to the signal candidate, wherein the noise attenuator is arranged to generate at least one of the first group and the second group by selecting a subset of codebook entries in response to the reference signal.

The desired signal component may specifically be a speech signal component.

The sensor signal may be received from a sensor which performs the measurement of the desired source and/or the noise. The measurement may be an acoustic measurement, e.g. by one or more microphones, but does not need to be so. For example, in some embodiments the measurement may be mechanical or visual measurement.

In accordance with an optional feature of the invention, the sensor signal represents a measurement of the desired source, and the noise attenuator is arranged to generate the first group by selecting a subset of codebook entries from the first codebook.

This may allow reduced complexity, facilitated operation and/or improved performance in many embodiments. In many embodiments, a particularly useful sensor signal can be generated for the desired signal source thereby allowing a reliable reduction of the number of desired signal candidates to search. For example, for a desired signal source being a speech source, an accurate yet different representation of the speech signal can be generated from a bone conduction microphone. Thus, specific characteristics of the desired signal source can in many scenarios advantageously be exploited to provide a substantial reduction in potential candidates based on a sensor signal distinct from the audio signal.

In accordance with an optional feature of the invention, the first signal is an audio signal, the desired source is an audio source, the desired signal component is a speech signal, and the sensor signal is a bone-conducting microphone signal.

This may provide a particularly efficient and high performing speech enhancement.

In accordance with an optional feature of the invention, the sensor signal provides a less accurate representation of the desired source than the desired signal component.

The invention may allow additional information provided by a signal of reduced quality (and thus potentially not suitable for direct noise attenuation or signal rendering) to be used to perform high quality noise attenuation.

In accordance with an optional feature of the invention, the sensor signal represents a measurement of the noise, and the noise attenuator is arranged to generate the second group by selecting a subset of codebook entries from the second codebook.

This may allow reduced complexity, facilitated operation and/or improved performance in many embodiments. In many embodiments, a particularly useful sensor signal can be generated for one or more noise sources (including diffuse noise) thereby allowing a reliable reduction of the number of noise signal candidates to search. In many embodiments, noise is more variable than a desired signal component. For example, a speech enhancement may be used in many different environments and thus in many different noise environments. Thus the characteristics of the noise may vary substantially whereas the speech characteristics tend to be relatively constant in the different environments. Therefore, the noise codebook may often include entries for many very different environments, and a sensor signal may in many scenarios allow a subset corresponding to the current noise environment to be generated.

In accordance with an optional feature of the invention, the sensor signal is a mechanical vibration detection signal.

This may allow a particularly reliable performance in many scenarios.

In accordance with an optional feature of the invention, the sensor signal is an accelerometer signal.

This may allow a particularly reliable performance in many scenarios.

In accordance with an optional feature of the invention, the noise attenuation apparatus further comprises a mapper for generating a mapping between a plurality of sensor signal candidates and codebook entries of at least one of the first codebook and the second codebook; and wherein the noise attenuator is arranged to select the subset of code book entries in response to the mapping.

This may allow reduced complexity, facilitated operation and/or improved performance in many embodiments. In particular, it may allow a facilitated and/or improved generation of suitable subset of candidates.

In accordance with an optional feature of the invention, the noise attenuator is arranged to select a first sensor signal candidate from the plurality of sensor signal candidates in response to a distance measure between each of the plurality of sensor signal candidates and the sensor signal, and to generate the subset in response to a mapping for the first signal candidate.

This may in many embodiments provide a particularly advantageous and practical generation of suitable mapping information allowing a reliable generation of a suitable subset of candidates.

In accordance with an optional feature of the invention, the mapper is arranged to generate the mapping based on simultaneous measurements from an input sensor originating the first signal and a sensor originating the sensor signal.

This may provide a particularly efficient implementation and may in particular reduce complexity and e.g. allow a facilitated and/or improved determination of a reliable mapping.

In accordance with an optional feature of the invention, the mapper is arranged to generate the mapping based on difference measures between the sensor signal candidates and the codebook entries of at least one of the first codebook and the second codebook.

This may provide a particularly efficient implementation and may in particular reduce complexity and e.g. allow a facilitated and/or improved determination of a reliable mapping.

In accordance with an optional feature of the invention, the first signal is a microphone signal from a first microphone, and the sensor signal is a microphone signal from a second microphone remote from the first microphone.

This may allow reduced complexity, facilitated operation and/or improved performance in many embodiments.

In accordance with an optional feature of the invention, the first signal is an audio signal and the sensor signal is from a non-audio sensor.

This may allow reduced complexity, facilitated operation and/or improved performance in many embodiments.

According to an aspect of the invention there is provided a method of noise attenuation comprising: receiving an first signal for an environment, the first signal comprising a desired signal component corresponding to a signal from a desired source in the environment and a noise signal component corresponding to noise in the environment; providing a first codebook comprising a plurality of desired signal candidates for the desired signal component, each desired signal candidate representing a possible desired signal component; providing a second codebook comprising a plurality of noise signal candidates for the noise signal component, each desired signal candidate representing a possible noise signal component; receiving a sensor signal providing a measurement of the environment, the sensor signal representing a measurement of the desired source or of the noise in the environment; segmenting the first signal into time segments; for each time segment, performing the steps of: generating a plurality of estimated signal candidates by for each pair of a desired signal candidate of a first group of codebook entries of the first codebook and a noise signal candidate of a second group of codebook entries of the second codebook generating a combined signal, generating a signal candidate for the first signal in the time segment from the estimated signal candidates, and attenuating noise of the first signal in the time segment in response to the signal candidate; and generating at least one of the first group and the second group by selecting a subset of codebook entries in response to the reference signal.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF THE SOME EMBODIMENTS OF THE INVENTION

The following description focuses on embodiments of the invention applicable to audio noise attenuation and specifically to speech enhancement by attenuation of noise. However, it will be appreciated that the invention is not limited to this application but may be applied to many other signals.

Figure 1:
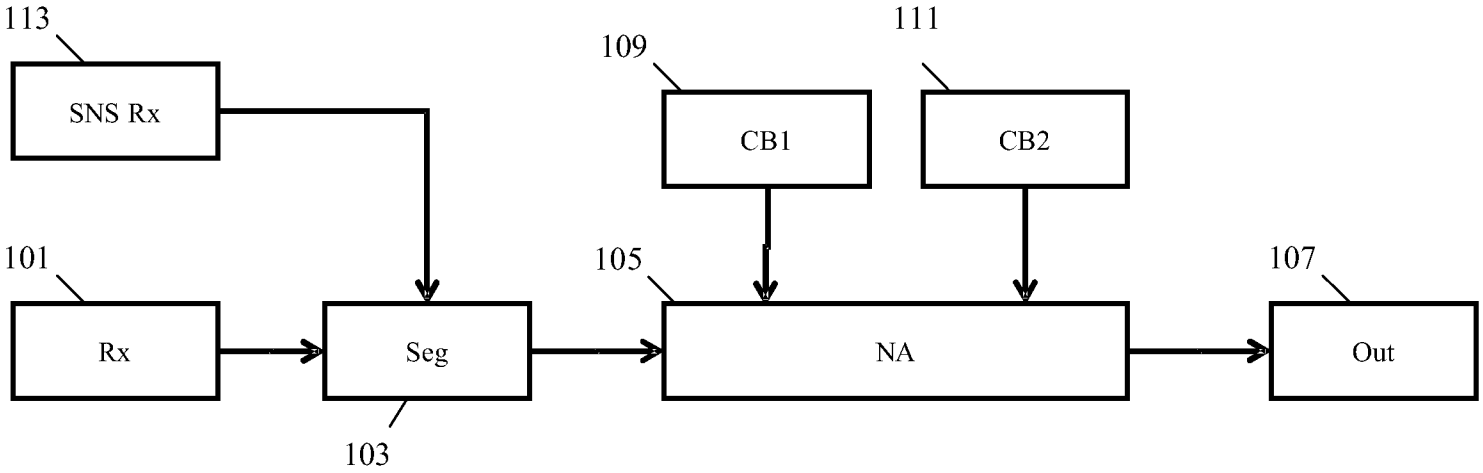
FIG. 1 is an illustration of an example of elements of a noise attenuation apparatus in accordance with some embodiments of the invention.

FIG. 1 illustrates an example of a noise attenuator in accordance with some embodiments of the invention.

The noise attenuator comprises a receiver 101 which receives a signal that comprises both a desired component and an undesired component. The undesired component is referred to as a noise signal and may include any signal component not being part of the desired signal component. The desired signal component corresponds to the sound generated from a desired sound source whereas the undesired or noise signal component may correspond to contributions from all other sound sources including diffuse and reverberant noise etc. The noise signal component may include ambient noise in the environment, audio from undesired sound sources, etc.

In the system of FIG. 1, the signal is an audio signal which specifically may be generated from a microphone signal capturing an audio signal in a given audio environment. The following description will focus on embodiments wherein the desired signal component is a speech signal from a desired speaker.

The receiver 101 is coupled to a segmenter 103 which segments the audio signal into time segments. In some embodiments, the time segments may be non-overlapping but in other embodiments the time segments may be overlapping. Further, the segmentation may be performed by applying a suitably shaped window function, and specifically the noise attenuating apparatus may employ the well-known overlap and add technique of segmentation using a suitable window, such as a Hanning or Hamming window. The time segment duration will depend on the specific implementation but will in many embodiments be in the order of 10-100 msecs.

The segmenter 103 is fed to a noise attenuator 105 which performs a segment based noise attenuation to emphasize the desired signal component relative to the undesired noise signal component. The resulting noise attenuated segments are fed to an output processor 107 which provides a continuous audio signal. The output processor 107 may specifically perform desegmentation, e.g. by performing an overlap and add function. It will be appreciated that in other embodiments the output signal may be provided as a segmented signal, e.g. in embodiments where further segment based signal processing is performed on the noise attenuated signal.

The noise attenuation is based on a codebook approach which uses separate codebooks relating to the desired signal component and to the noise signal component. Accordingly, the noise attenuator 105 is coupled to a first codebook 109 which is a desired signal codebook, and in the specific example is a speech codebook. The noise attenuator 105 is further coupled to a second codebook 111 which is a noise signal codebook The noise attenuator 105 is arranged to select codebook entries of the speech codebook and the noise codebook such that the combination of the signal components corresponding to the selected entries most closely resembles the audio signal in that time segment. Once the appropriate codebook entries have been found (together with a scaling of these), they represent an estimate of the individual speech signal component and noise signal component in the captured audio signal. Specifically, the signal component corresponding to the selected speech codebook entry is an estimate of the speech signal component in the captured audio signal and the noise codebook entries provide an estimate of the noise signal component. Accordingly, the approach uses a codebook approach to estimate the speech and noise signal components of the audio signal and once these estimates have been determined they can be used to attenuate the noise signal component relative to the speech signal component in the audio signal as the estimates makes it possible to differentiate between these.

In the system of FIG. 1, the noise attenuator 105 is thus coupled to a desired signal codebook 109 which comprises a number of codebook entries each of which comprises a set of parameters defining a possible desired signal component, and in the specific example a desired speech signal. Similarly, the noise attenuator 105 is coupled to a noise signal codebook 109 which comprises a number of codebook entries each of which comprises a set of parameters defining a possible noise signal component.

The codebook entries for the desired signal component correspond to potential candidates for the desired signal components and the codebook entries for the noise signal component correspond to potential candidates for the noise signal components. Each entry comprises a set of parameters which characterize a possible desired signal or noise component respectively. In the specific example, each entry of the first codebook 109 comprises a set of parameters which characterize a possible speech signal component. Thus, the signal characterized by a codebook entry of this codebook is one that has the characteristics of a speech signal and thus the codebook entries introduce the knowledge of speech characteristics into the estimation of the speech signal component.

The codebook entries for the desired signal component may be based on a model of the desired audio source, or may additionally or alternatively be determined by a training process. For example, the codebook entries may be parameters for a speech model developed to represent the characteristics of speech. As another example, a large number of speech samples may be recorded and statistically processed to generate a suitable number of potential speech candidates that are stored in the codebook. Similarly, the codebook entries for the noise signal component may be based on a model of the noise, or may additionally or alternatively be determined by a training process.

Specifically, the codebook entries may be based on a linear prediction model. Indeed, in the specific example, each entry of the codebook comprises a set of linear prediction parameters. The codebook entries may specifically have been generated by a training process wherein linear prediction parameters have been generated by fitting to a large number of signal samples.

The codebook entries may in some embodiments be represented as a frequency distribution and specifically as a Power Spectral Density (PSD). The PSD may correspond directly to the linear prediction parameters.

The number of parameters for each codebook entry is typically relatively small. Indeed, typically, there are no more than 20, and often no more than 10, parameters specifying each codebook entry. Thus, a relative coarse estimation of the desired signal component is used. This allows reduced complexity and facilitated processing but has still been found to provide efficient noise attenuation in most cases.

In more detail, consider an additive noise model where speech and noise are assumed to be independent:

$$y(n)=x(n)+w(n),$$

where y(n), x(n) and w(n) represent the sampled noisy speech (the input audio signal), clean speech (the desired speech signal component) and noise (the noise signal component) respectively.

A codebook based noise attenuation typically includes searches through codebooks to find a codebook entry for the signal component and noise component respectively, such that the scaled combination most closely resembles the captured signal thereby providing an estimate of the speech and noise components for each short-time segment. Let $P_y(\omega)$ denote the Power Spectral Density (PSD) of the observed noisy signal y(n), $P_x(\omega)$ denote the PSD of the speech signal component x(n), and $P_w(\omega)$ denote the PSD of the noise signal component w(n), then.

$$P_y(\omega)=P_x(\omega)+P_w(\omega)$$

Letting ^ denote the estimate of the corresponding PSD, a traditional codebook based noise attenuation may reduce the noise by applying a frequency domain Wiener filter H(ω) to the captured signal, i.e.:

$$P_{na}(\omega)=P_y(\omega)H(\omega)$$

where the Wiener filter is given by:

$$H(\omega)=\frac{\hat{P}_x(\omega)}{\hat{P}_x(\omega)+\hat{P}_w(\omega)},$$

The codebooks comprise speech signal candidates and noise signal candidates respectively and the critical problem is to identify the most suitable candidate pair and the relative weighting of each.

The estimation of the speech and noise PSDs, and thus the selection of the appropriate candidates, can follow either a maximum-likelihood (ML) approach or a Bayesian minimum mean-squared error (MMSE) approach.

The relation between a vector of linear prediction coefficients and the underlying PSD can be determined by $$P_x(\omega)=\frac{1}{|A_x(\omega)|^2},$$

where $\theta_x=(\alpha_{x_0},\ldots,\alpha_{x_p})$ are the linear prediction coefficients, $\alpha_{x_0}=1$ and p is the linear prediction model order, and $A_x(\omega)=\Sigma_{k=0}^{p}\alpha_{x_k}e^{-j\omega k}$.

Using this relation, the estimated PSD of the captured signal is given by $$\hat{P}_y(\omega)=\underbrace{g_xP_x(\omega)}_{\equiv\hat{P}_x(\omega)}+\underbrace{g_wP_w(\omega)}_{\equiv\hat{P}_w(\omega)},$$

where $g_x$ and $g_w$ are the frequency independent level gains associated with the speech and noise PSDs. These gains are introduced to account for the variation in the level between the PSDs stored in the codebook and that encountered in the input audio signal.

Conventional approaches are based on a search through all possible pairings of a speech codebook entry and a noise codebook entry to determine the pair that maximizes a certain similarity measure between the observed noisy PSD and the estimated PSD as described in the following.

Consider a pair of speech and noise PSDs, given by the $i^{th}$ PSD from the speech codebook and the $j^{th}$ PSD from the noise codebook. The noisy PSD corresponding to this pair can be written as $$\hat{P}_y^{ij}(\omega)=g_x^{ij}P_x^{i}(\omega)+g_w^{ij}P_w^{j}(\omega).$$

In this equation, the PSDs are known whereas the gains are unknown. Thus, for each possible pair of speech and noise PSDs, the gains must be determined. This can be done based on a maximum likelihood approach. The maximum-likelihood estimate of the desired speech and noise PSDs can be obtained in a two-step procedure. The logarithm of the likelihood that a given pair $g_x^{ij}P_x^{i}(\omega)$ and $g_w^{ij}P_w^{j}(\omega)$ have resulted in the observed noisy PSD is represented by the following equation:

$$L_{ij}\left(P_y(\omega),\hat{P}_y^{ij}(\omega)\right)=\int_0^{2\pi}-\frac{P_y(\omega)}{\hat{P}_y^{ij}(\omega)}+\ln\left(\frac{1}{\hat{P}_y^{ij}(\omega)}\right)d\omega=$$
$$\int_0^{2\pi}-\frac{P_y(\omega)}{g_x^{ij}P_x^{i}(\omega)+g_w^{ij}P_w^{j}(\omega)}+\ln\left(\frac{1}{g_x^{ij}P_x^{i}(\omega)+g_w^{ij}P_w^{j}(\omega)}\right)d\omega.$$

In the first step, the unknown level terms $g_x^{ij}$ and $g_w^{ij}$ that maximize $L_{ij}(P_y(\omega),\hat{P}_y^{ij}(\omega)$ are determined. One way to do this is by differentiating with respect to $g_x^{ij}$ and $g_x^{ij}$, setting the result to zero, and solving the resulting set of simultaneous equations. However, these equations are non-linear and not amenable to a closed-form solution. An alternative approach is based on the fact that the likelihood is maximized when $P_y(\omega)=\hat{P}_y^{ij}(\omega)$, and thus the gain terms can be obtained by minimizing the spectral distance between these two entities.

Once the level terms are known, the value of $L_{ij}(P_y(\omega),\hat{P}_y^{ij}(\omega)$ can be determined as all entities are known. This procedure is repeated for all pairs of speech and noise codebook entries, and the pair that results in the largest likelihood is used to obtain the speech and noise PSDs. As this step is performed for every short-time segment, the method can accurately estimate the noise PSD even under non-stationary noise conditions.

Let {i*, j*} denote the pair resulting in the largest likelihood for a given segment, and let $g_x^*$ and $g_w^*$ denote the corresponding level terms. Then the speech and noise PSDs are given by $$\hat{P}_x(\omega)=g^*_xP_x^{i*}$$

$$\hat{P}_w(\omega)=g^*_wP_w^{j*}$$

These results thus define the Weiner filter which is applied to the input audio signal to generate the noise attenuated signal.

Thus, the prior art is based on finding a suitable desired signal codebook entry which is a good estimate for the speech signal component and a suitable noise signal codebook entry which is a good estimate for the noise signal component. Once these are found, an efficient noise attenuation can be applied.

However, the approach is very complex and resource demanding. In particular, all possible pairs of the noise and speech codebook entries must be evaluated to find the best match. Further, since the codebook entries must represent a large variety of possible signals this results in very large codebooks, and thus in many possible pairs that must be evaluated. In particular, the noise signal component may often have a large variation in possible characteristics, e.g. depending on specific environments of use etc. Therefore, a very large noise codebook is often required to ensure a sufficiently close estimate. This results in very high computational demands.

In the system of FIG. 1, the complexity and in particular the computational resource usage of the noise attenuation algorithm may be substantially reduced by using a second signal to reduce the number of codebook entries the algorithm searches over. In particular, in addition to receiving an audio signal for noise attenuation from a microphone, the system also receives a sensor signal which provides a measurement of predominantly the desired signal component or predominantly the noise signal component.

The noise attenuator of FIG. 1 accordingly comprises a sensor receiver 113 which receives a sensor signal from a suitable sensor. The sensor signal provides a measurement of the audio environment such that it represents a measurement of the desired audio source or a measurement of the audio environment.

In the example, the sensor receiver 113 is coupled to the segmenter 103 which proceeds to segment the sensor signal into the same time segments as the audio signal. However, it will be appreciated that this segmentation is optional and that in other embodiments the sensor signal may for example be segmented into time segments that are longer, shorter, overlapping or disjoint etc. with respect to the segmentation of the audio signal.

In the example of FIG. 1, the noise attenuator 105 accordingly for each segment receives the audio signal and a sensor signal which provides a different measurement of the desired audio source or of the noise in the audio environment. The noise attenuator then uses the additional information provided by the sensor signal to select a subset of codebook entries for the corresponding codebook. Thus, when the sensor signal represents a measurement of the desired audio source, the noise attenuator 105 generates a subset of desired signal candidates. The search is then performed over the possible pairings of a noise signal candidate in the noise codebook 111 and a candidate in the generated subset of desired signal candidates. When the sensor signal represents a measurement of the noise environment, the noise attenuator 105 generates a subset of desired noise candidates from the noise codebook 111. The search is then performed over the possible pairings of a desired signal candidate in the desired signal codebook 109 and a candidate in the generated subset of noise signal candidates.

Figure 2:
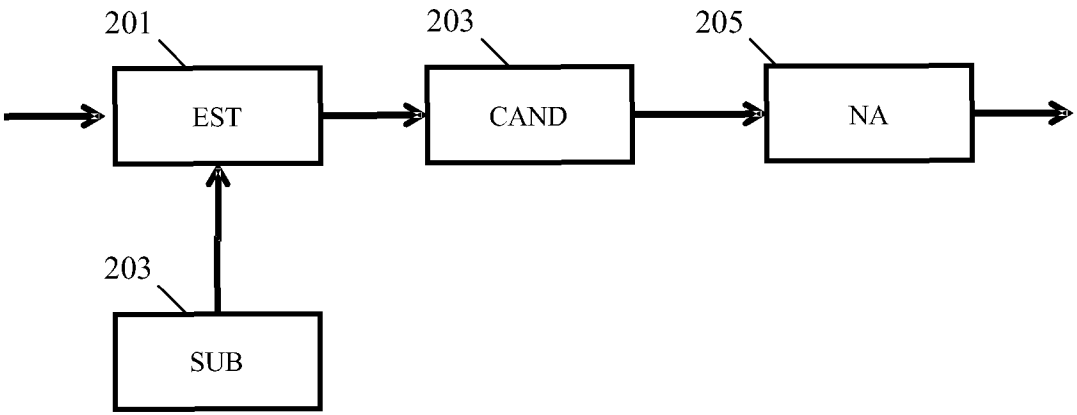
FIG. 2 is an illustration of an example of elements of a noise attenuator for the noise attenuation apparatus of FIG. 1.

FIG. 2 illustrates an example of some elements of the noise attenuator 105. The noise attenuator comprises an estimation processor 201 which generates a plurality of estimated signal candidates by for each pair of a desired signal candidate of a first group of codebook entries of the desired signal codebook and a noise signal candidate of a second group of codebook entries of the noise codebook generating a combined signal. Thus, the estimation processor 201 generates an estimate of the received signal for each pairing of a noise candidate from a group of candidates (codebook entries) of the noise codebook and a desired signal candidate from a group of candidates (codebook entries) of the desired signal codebook. The estimate for a pair of candidates may specifically be generated as the weighted sum, and specifically a weighted summation, that results in a minimization of a cost function.

The noise attenuator 105 further comprises a group processor 203 which is arranged to generate at least one of the first group and the second group by selecting a subset of codebook entries in response to the reference signal. Thus, either the first or second group may simply be equal to the entire codebook but at least one of the groups is generated as a subset of a code book, where the subset is generated on the basis of the sensor signal.

The estimation processor 201 is further coupled to a candidate processor 205 which proceeds to generate a signal candidate for the input signal in the time segment from the estimated signal candidates. For example, the candidate may simply be generated by selecting the estimate resulting in the lowest cost function. Alternatively, the candidate may be generated as a weighted combination of the estimates where the weights depend on the value of the cost function.

The candidate processor 205 is coupled to a noise attenuation processor 207 which proceeds to attenuate noise of the input signal in the time segment in response to the generated signal candidate. For example, a Wiener filter may be applied as previously described.

The second sensor signal may thus be used to provide additional information that can be used to control the search such that this can be reduced substantially. However, the sensor signal is not directly affecting the audio signal but only guides the search to find the optimum estimate. As a result, distortions, noise, inaccuracies etc. in the measurement by the sensor will not directly impact the signal processing or the noise attenuation and will therefore not directly introduce any signal quality degradation. As a consequence the sensor signal may have a substantially reduced quality and may in particular for the desired signal measurement be a signal which would provide inadequate audio (and specifically speech) quality if used directly. As a consequence, a wide variety of sensors can be used, and in particular sensor that may provide substantially different information than a microphone capturing the audio signal, such as e.g. non-audio sensors.

In some embodiments, the sensor signal may represent a measurement of the desired audio source with the sensor signal specifically providing a less accurate representation of the desired audio source than the desired signal component of the audio signal.

For example, a microphone may be used to capture speech from a person in a noisy environment. A different type of sensor may be used to provide a different measurement of the speech signal which however may not be of sufficient quality to provide reliable speech yet be useful for narrowing the search in the speech codebook.

An example of a reference sensor that predominantly captures only the desired signal is a bone-conducting microphone which can be worn near the throat of the user. This bone-conducting microphone will capture speech signals propagating through (human) tissue. Because this sensor is in contact with the user's body and shielded from the external acoustic environment, it can capture the speech signal with a very high signal-to-noise ratio, i.e. it provides a sensor signal in the form of a bone-conducting microphone signal wherein the signal energy resulting from the desired audio source (the speaker) is substantially higher (say at least 10 dB or more) than the signal energy resulting from other sources.

However, due to the location of the sensor, the quality of the captured signal is much different from that of air-conducted speech which is picked up by a microphone placed in front of the user's mouth. The resulting quality is thus not sufficient to be used as a speech signal directly but is highly suitable for guiding the codebook based noise attenuation to search only a small subset of the speech codebook.

Thus, unlike conventional approaches which require a joint enhancement using large speech and noise codebooks, the approach of FIG. 1 only needs to perform optimization over a small subset of the speech codebook due to the presence of a clean reference signal. This results in significant savings in computational complexity since the number of possible combinations reduce drastically with reducing number of candidates. Furthermore, the use of a clean reference signal enables a selection of a subset of the speech codebook that closely models the true clean speech, i.e. the desired signal component. Accordingly, the likelihood of selecting an erroneous candidate is substantially reduced and thus the performance of the entire noise attenuation may be improved.

In other embodiments, the sensor signal may represents a measurement of the noise in the audio environment, and the noise attenuator 105 may be arranged to reduce the number of candidates/entries of the noise codebook 111 that are considered.

The noise measurement may be a direct measurement of the audio environment or may for example be an indirect measurement using a sensor of a different modality, i.e. using a non-audio sensor.

As an example of an audio sensor may be a microphone positioned remote from the microphone capturing the audio signal. For example, the microphone capturing the speech signal may be positioned close to the speaker's mouth whereas a second microphone is used to provide the sensor signal. The second microphone may be positioned at a position where the noise dominates the speech signal and specifically may be positioned sufficiently remote from the speaker's mouth. The audio sensor may be sufficiently remote for the ratio between the energy originating from the desired sound source and the noise energy has reduced by no less than 10 dB in the sensor signal relative to the captured audio signal.

In some embodiments a non-audio sensor may be used to generate e.g. a mechanical vibration detection signal. For example, an accelerometer may be used to generate a sensor signal in the form of an accelerometer signal. Such a sensor could for example be mounted on a communication device and detect vibrations thereof. As another example, in embodiments wherein a specific mechanical entity is known to be the main source of noise, an accelerometer may be attached to the device to provide a non-audio sensor signal. As a specific example, in a laundry application, accelerometers may be positioned on washing machines or spinners.

As another example, the sensor signal may be a visual detection signal. E.g. a video camera may be used to detect characteristics of the visual environment that are indicative of the audio environment. For example, the video detection may allow a detection of whether a given noise source is active and may be used to reduce the search of noise candidates to a corresponding subset. (A visual sensor signal can also be used for reducing the number of desired signal candidates searched, e.g. by applying lip reading algorithms to a human speaker to get a rough indication of suitable candidates, or e.g. by using a face recognition system to detect a speaker such that the corresponding codebook entries can be selected).

Such noise reference sensor signals may then be used to select a subset of the noise codebook entries that are searched. This may not only efficiently reduce the number of pairs of entries of the codebooks that must be considered, and thus substantially reduce the complexity, but may also result in more accurate noise estimation and thus improved noise attenuation.

The sensor signal represents a measurement of either the desired signal source or of the noise. However, it will be appreciated that the sensor signal may also include other signal components, and in particular that the sensor signal may in some scenarios include contributions from both the desired sound source and from the noise in the environment. However, the distribution or weight of these components will be different in the sensor signal and specifically one of the components will typically be dominant. Typically, the energy/power of the component corresponding to the codebook for which the subset is determined (i.e. the desired signal or the noise signal) is no less than 3 dB, 10 dB or even 20 dB higher than the energy of the other component.

Once the search has been performed over all candidate pairs of codebook entries, a signal candidate estimate is generated for each pair together with typically an indication of how closely the estimate fits the measured audio signal. A signal candidate is then generated for the time segment based on the estimated signal candidates. The signal candidate can be generated by considering a likelihood estimate of the signal candidate resulting in the captured audio signal.

As a low complexity example, the system may simply select the estimated signal candidate having the highest likelihood value. In more complex embodiments, the signal candidate may be calculated by a weighted combination, and specifically summation, of all estimated signal candidates wherein the weighting of each estimated signal candidate depends on the log likelihood value.

The audio signal is then compensated based on the calculated signal candidate. In particular, by filtering the audio signal with the Wiener filter:

$$H(\omega) = \frac{\hat{P}_x(\omega)}{\hat{P}_x(\omega) + \hat{P}_w(\omega)},$$

It will be appreciated that other approaches for reducing noise based on the estimated signal and noise components may be used. For example, the system may subtract the estimated noise candidate from the input audio signal.

Thus, noise attenuator 105 generates an output signal from the input signal in the time segment in which the noise signal component is attenuated relative to the speech signal component.

It will be appreciated that in different embodiments, different approaches may be used to determine the subset of code book entries. For example, in some embodiments, the sensor signal may be parameterized equivalently to the codebook entries, e.g. by representing it as a PSD having parameters corresponding to those of the codebook entries (specifically using the same frequency range for each parameter). The closest match between the sensor signal PSD and the codebook entries may then be found using a suitable distance measure, such as a square error. The noise attenuator 105 may then select a predetermined number of codebook entries closest to the identified match.

However, in many embodiments, the noise attenuation system may be arranged to select the subset based on a mapping between sensor signal candidates and codebook entries. The system may thus comprise a mapper 301 as illustrated in FIG. 2 where the mapper 301 is arranged to generate the mapping from sensor signal candidates to codebook candidates.

Figure 3:
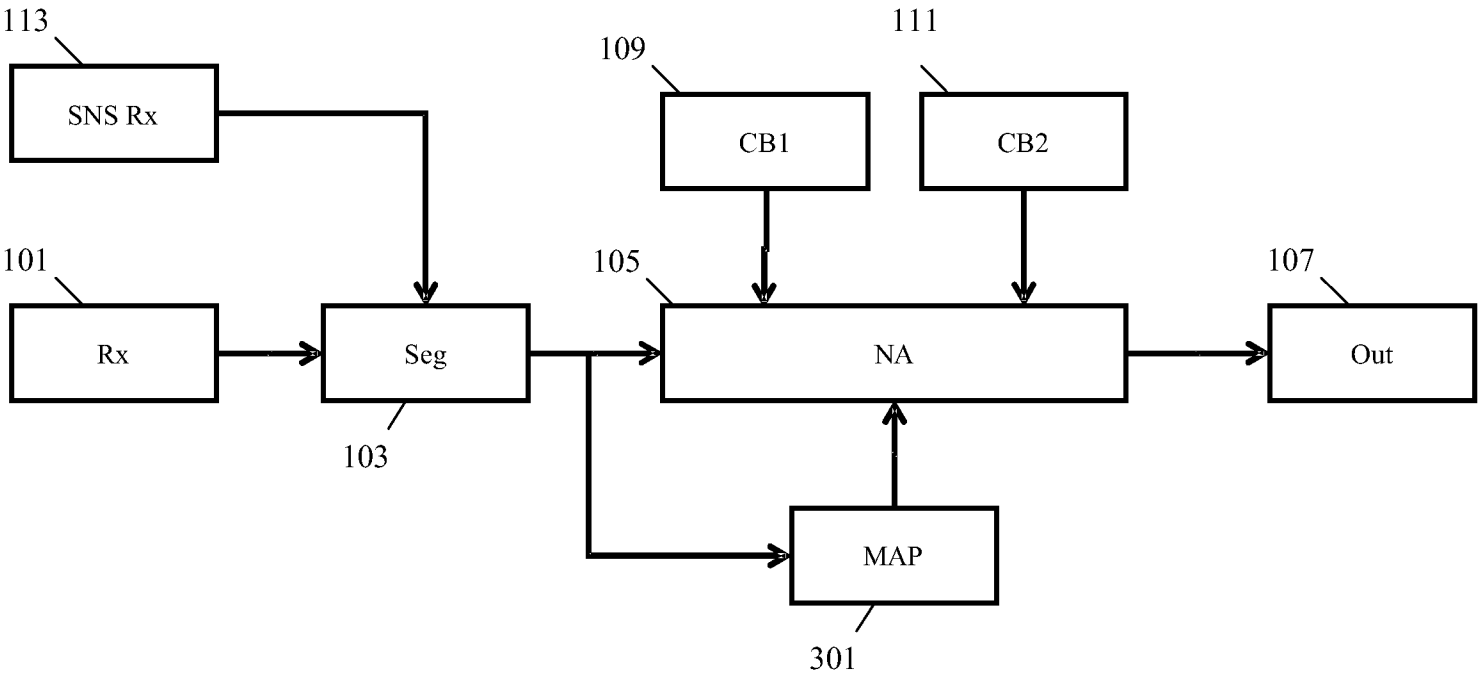
FIG. 3 is an illustration of an example of elements of a noise attenuation apparatus in accordance with some embodiments of the invention.
Figure 4:
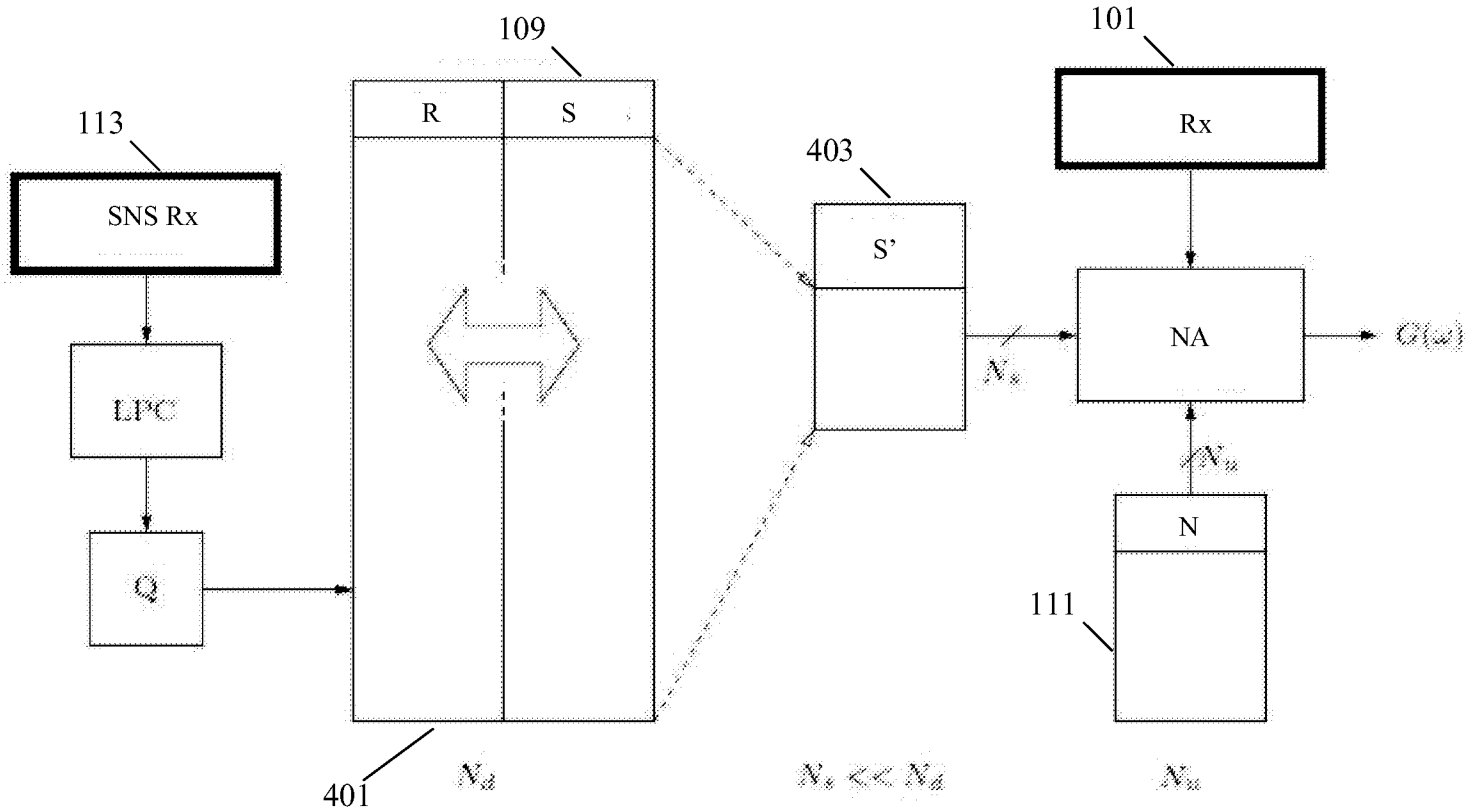
FIG. 4 is an illustration of a codebook mapping for a noise attenuation apparatus in accordance with some embodiments of the invention.

The mapping is fed from the mapper 301 to the noise attenuator 105 where it is used to generate the subset of one of the codebooks. FIG. 3 illustrates an example of how the noise attenuator 105 may operate for the example where the sensor signal is for the desired signal.

In the example, linear LPC parameters are generated for the received sensor signal and the resulting parameters are quantized to correspond to the possible sensor signal candidates in the generated mapping 401. The mapping 401 provides a mapping from a sensor signal codebook comprising sensor signal candidates to speech signal candidates in the speech codebook 109. This mapping is used to generate a subset of speech codebook entries 403.

The noise attenuator 105 may specifically search through the stored sensor signal candidates in the mapping 401 to determine the sensor signal candidate which is closest to the measured sensor in accordance with a suitable distance measure, such as e.g. a sum square error for the parameters. It may then generate the mapping based on this subset e.g. by including the speech signal candidate(s) that are mapped to the identified sensor signal candidate in the subset. The subset may be generated to have a desired size, e.g. by including all speech signal candidates for which a given distance measure to the selected speech signal candidate is less than a given threshold, or by including all speech signal candidates mapped to a sensor signal candidate for which a given distance measure to the selected sensor signal candidate is less than a given threshold.

Based on the audio signal, a search is performed over the subset 403 and the entries of the noise codebook 111 to generate the estimated signal candidates and then the signal candidate for the segment as previously described. It will be appreciated that the same approach can alternatively or additionally be applied to the noise codebook 111 based on a noise sensor signal.

The mapping may specifically be generated by a training process which may generate both the codebook entries and the sensor signal candidates.

Generation of an N-entry codebook for a particular signal can be based on training data and may e.g. be based on the Linde-Buzo-Gray (LBG) algorithm described in Y. Linde, A. Buzo, and R. Gray, "An algorithm for vector quantizer design," Communications, IEEE Transactions on, vol. 28, no. 1, pp. 84-95, January 1980.

Specifically let X denote a set of L training vectors with elements $x_k \epsilon X$ ($1 \le k \le L$) of length M. The algorithm begins by computing a single codebook entry which corresponds to the mean of the training vectors, i.e. $c_0 = \overline{X}$. This entry is then split into two such that $$c_1 = (1+\eta)c_0$$

$$c_2 = (1-\eta)c_0,$$

where $\eta$ is a small constant. The algorithm then divides the training vectors into two partitions $X_1$ and $X_2$ such that $$x_k \in \begin{cases} X_1 & \text{iff } d(x_k, c_1) < d(x_k, c_2) \\ X_2 & \text{iff } d(x_k, c_2) < d(x_k, c_1) \end{cases}$$

where d(.;.) is some distortion measure such as mean-squared error (MSE) or weighted MSE (WMSE). The current codebook entries are then redefined according to:

$$c_1 = \overline{X_1}$$

$$c_2 = \overline{X_2}$$

The previous two steps are repeated until the overall codebook error does not change with the current codebook entries. Each codebook entry is then split again and the same process is repeated until the number of entries equals N.

Let R and Z denote the set of training vectors for the same sound source (either desired or undesired/noise) captured by the reference sensor and the audio signal microphone, respectively. Based on these training vectors a mapping between the sensor signal candidates and a primary codebook (the term primary denoting either the noise or desired codebook as appropriate) of length $N_d$ can be generated.

The codebooks can e.g. be generated by first generating the two codebooks of the mapping (i.e. of the sensor candidates and the primary candidates) independently using the LBG algorithm described above, followed by creating a mapping between the entries of these codebooks. The mapping can be based on a distance measure between all pairs of codebook entries so as to create either a 1-to-1 (or 1-to-many/many-to-1) mapping between the sensor codebook and the primary codebook.

As another example, the codebook generation for the sensor signal may be generated together with the primary codebook. Specifically, in this example, the mapping can be based on simultaneous measurements from the microphone originating the audio signal and from the sensor originating the sensor signal. The mapping is thus based on the different signals capturing the same audio environment at the same time.

In such an example, the mapping may be based on assuming that the signals are synchronized in time, and the sensor candidate codebook can be derived using the final partitions resulting from applying the LBG algorithm to the primary training vectors. If the set of (primary codebook) partitions is given as $$Z = \{Z_1, Z_2, \ldots, Z_{N_d}\},$$

then the set of partitions corresponding to the reference sensor R can be generated such that:

$$r_k \epsilon R_j \text{ iff } z_k \epsilon Z_j \quad 1 \le k \le L, \; 1 \le j \le N_d.$$

The resulting mapping can then be applied as previously described.

The system can be used in many different applications including for example applications that require single microphone noise reduction, e.g., mobile telephony and DECT phones. As another example, the approach can be used in multi-microphone speech enhancement systems (e.g., hearing aids, array based hands-free systems, etc.), which usually have a single channel post-processor for further noise reduction.

Indeed, whereas the previous description has been directed to attenuation of audio noise in an audio signal, it will be appreciated that the described principles and approaches can be applied to other types of signals. Indeed, it is noted that any input signal comprising a desired signal component and noise can be noise attenuated using the described codebook approach.

An example of such a non-audio embodiment may be a system wherein breathing rate measurements are made using an accelerometer. In this case the measurement sensor can be placed near the chest of the person being tested. In addition, one or more additional accelerometers can be positioned on a foot (or both feet) to remove noise contributions which could appear on the primary accelerometer signal(s) during walking/running. Thus, these accelerometers mounted on the test persons feet can be used to narrow the noise codebook search.

It will also be appreciated that a plurality of sensors and sensor signals can be used to generate the subset of codebook entries that are searched. These multiple sensor signals may be used individually or in parallel. For example, the sensor signal used may depend on a class, category or characteristic of the signal, and thus a criterion may be used to select which sensor signal to base the subset generation on. In other examples, a more complex criterion or algorithm may be used to generate the subset where the criterion or algorithm considers a plurality sensor signals simultaneously.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. A noise attenuation apparatus comprising:

a receiver configured to receive a first signal comprising a desired signal component corresponding to a signal from a desired source and a noise signal component corresponding to noise;

an input device configured to receive a reference signal providing a measurement of one of: the signal from the desired source and the noise, said input device being different than said receiver, and the reference signal represents a different measurement of one of: the signal from the desired source and the noise, wherein a quality of the reference signal is less than that of that of the first signal;

a processor configured to segment the first signal into time segments;

a noise attenuator processor configured to perform, for each time segment:

accessing:

a plurality of desired signal candidates, wherein each of said desired signal candidates represents a possible desired signal component; and a plurality of noise signal candidates, wherein each of said noise signal candidates represents a possible noise signal component;

generating, based in the reference signal, one of: a first group of desired signal candidates from the plurality of desired signal candidates and a second group of noise signal components from the plurality of noise signal candidates;

generating a plurality of estimated signal candidates comprising:

a desired signal candidate selected from one of: the plurality of desired signal candidates and the first group of desired signal candidates; and a noise signal candidate selected from one of: the plurality of noise signal candidates and the second group of noise signal candidates;

selecting a signal candidate for the first signal in the time segment from the plurality of estimated signal candidates, and attenuating the noise signal component of the first signal in the time segment in response to the selected signal candidate.

2. The noise attenuation apparatus of claim 1 wherein the reference signal represents a measurement of the signal from the desired source and the noise attenuator is configured to generate the first group by selecting a subset of the plurality of desired signal candidates based on the reference signal.

3. The noise attenuation apparatus of claim 2 wherein the first signal is a speech signal and the reference signal is a bone-conducting microphone signal.

4. The noise attenuation apparatus of claim 2 wherein the reference signal provides a representation of the signal from the desired source.

5. The noise attenuation apparatus of claim 1 wherein the reference signal represents a measurement of the noise, and the noise attenuator is configured to generate the second group by selecting a subset of the plurality of noise candidates.

6. The noise attenuation apparatus of claim 1 wherein the reference signal is a mechanical vibration detection signal.

7. The noise attenuation apparatus of claim 1 wherein the reference signal is an accelerometer signal.

8. The noise attenuation apparatus of claim 1 further comprising:

a mapper configured to generate a mapping between a plurality of sensor signal candidates and entries of at least one of the plurality of desired signal candidates and the plurality of noise candidates wherein the noise attenuator is configured to select the subset of the entries in response to the mapping.

9. The noise attenuation apparatus of claim 8 wherein the noise attenuator is configured to:

select a first reference sensor signal candidate from the plurality of sensor signal candidates in response to a distance measure between each of the plurality of sensor signal candidates and the reference signal, and generate the subset in response to a mapping for the first signal candidate.

10. The noise attenuation apparatus of claim 8, wherein the mapper is configured to:

generate the mapping based on simultaneous measurements from an input sensor device originating the first signal and a sensor device originating the reference signal.

11. The noise attenuation apparatus of claim 8, wherein the mapper is configured to:

generate the mapping based on difference measures between the sensor signal candidates and the entries of at least one of the plurality of desired signal candidates and the plurality of the noise signal candidates.

12. The noise attenuation apparatus of claim 1 wherein the first signal is a microphone signal from a first microphone, and the reference signal is a microphone signal from a second microphone remote from the first microphone.

13. The noise attenuating apparatus of claim 1 wherein the first signal is an audio signal and the reference signal is a non-audio signal.

14. A method of noise attenuation, operable in a noise attenuation system, the noise attenuation system comprising:

a processor, which when executes the method, causes the processor to execute the steps of:

receiving a first signal comprising a desired signal component corresponding to a signal from a desired source and a noise signal component corresponding to noise;

accessing a plurality of desired signal candidates for the desired signal component, each desired signal candidate representing a possible desired signal component;

accessing a plurality of noise signal candidates for the noise signal component, each desired noise signal candidate representing a possible noise signal component;

recieiving a reference signal representing-measurement of at least one of: a signal transmitted by the desired source and a noise in the environment, wherein the reference signal provides a different measurement of the one of: the signal transmitted by the desired source and the noise and is of a lower quality than the signal transmitted by the desired source;

generating one of: a first group of desired signal candidates based on the reference signal and a second group of noise signal candidates based on the reference singal;

generating a plurality of estimated signal candidates, each estimated signal candidate comprising one of: a desired signal candidate selected from the plurality of desired signal candidates and the second group of noise signal candidates and the first group of desired signal candidates and the plurality if noise signal candidates;

selecting from the plurality of estimated signal candidates, a signal candidate for the first signal, and attenuating noise of the first signal in response to the selected signal candidate.

15. A computer program product stored on a non-transitory medium which is not a signal or a wave, the product comprising computer program code which when accessed by a computer causes the computer to perform:

receiving a first signal comprising a desired signal component corresponding to a signal from a desired source and a noise signal component corresponding to noise;

accessing a plurality of desired signal candidates for the desired signal component, each desired signal candidate representing a possible desired signal component;

accessing a plurality of noise signal candidates for the noise signal component, each desired noise signal candidate representing a possible noise signal component;

receiving a reference signal representing-measurement of at least one of: a signal transmitted by the desired source and a noise in the environment, wherein the reference signal provides a different measurement of the one of: the signal transmitted by the desired source and the noise, wherein the reference signal is of a lower quality than the signal transmitted by the desired source;

generating a plurality of estimated signal candidates, each estimated signal candidate comprising: a desired signal candidate selected from the plurality of desired signal candidates and a noise signal candidate selected from the plurality of noise signal candidates, wherein one of: said desired signal candidate and said noise signal candidate is selected based on the reference signal;

selecting from the plurality of estimated signal candidates, a signal candidate for the first signal, and attenuating noise of the first signal in response to the selected signal candidate.

* * * * *